United States Patent [19]

Eaby et al.

[11] 4,443,052

[45] Apr. 17, 1984

[54] MEANS TO INDICATE FULLY-MATED CONDITION OF ELECTRICAL CONNECTOR

[75] Inventors: Daniel G. Eaby, Mt. Joy; John R. Shuey, Carlisle, both of Pa.

[73] Assignee: AMP Incorporated, Harrisburg, Pa.

[21] Appl. No.: 345,962

[22] Filed: Feb. 5, 1982

[51] Int. Cl.[3] ..... H01R 13/627; H01R 13/639

[52] U.S. Cl. ..... 339/113 R; 339/89 M

[58] Field of Search ..... 339/69 R-90 C, 339/91 B, 113 R

[56] References Cited

U.S. PATENT DOCUMENTS

| | | | |
|---|---|---|---|
| 3,646,496 | 2/1972 | Williams | 339/89 M X |
| 4,239,315 | 12/1980 | Lacaze | 339/113 R X |
| 4,277,125 | 7/1981 | Ball | 339/113 R |

FOREIGN PATENT DOCUMENTS

| | | | |
|---|---|---|---|
| 2059185 | 4/1981 | United Kingdom | 339/113 R |

OTHER PUBLICATIONS

"Clicking Connector", Panaro, IBM Tech. Discl. Bull. vol. 1, No. 4, p. 15, 12-1958.

*Primary Examiner*—Eugene F. Desmond

*Attorney, Agent, or Firm*—Adrian J. LaRue

[57] ABSTRACT

An electrical connector comprises a connector plug part and a connector receptacle part, each part comprising a molded insert and a metal cylindrical shell within which the insert is fitted and retained. The insert of the receptacle part has passageways therethrough in which are secured electrical pin terminals and an integral hood which extends beyond the mating face of the receptacle insert and the shell of the receptacle part also has a hood which extends forwardly beyond the insert hood. The plug part comprises an insert in which passageways extend therethrough in which are secured electrical receptacle terminals and a shell which has an internal surface that is radially spaced from the external surface of the plug insert so that when the two parts are mated, the hood of the receptacle insert will be received between the external surface of the plug insert and the internal surface of the plug shell. The hood of the receptacle shell extends over the external surface of the plug shell when the parts are mated and threads or the like on the external surface of the receptacle shell hood are engaged by threads provided on the internal surface of a metal coupling ring which is rotationally mounted on the plug shell. A pin member extends across the threads and engages a groove in the threads of the receptacle shell hood and the coupling ring to provide an audible and tactile indication of a fully-mated condition of the plug and receptacle parts.

15 Claims, 5 Drawing Figures

MEANS TO INDICATE FULLY-MATED CONDITION OF ELECTRICAL CONNECTOR

FIELD OF THE INVENTION

This invention relates to electrical connectors and more particularly to means to indicate fully-mated condition of electrical connectors.

BACKGROUND OF THE INVENTION

U.S. Pat. No. 3,901,574 discloses an electrical connector including a plug and receptacle threadably fastened to one another by a flexible plastic coupling ring. Lug means on the flexible coupling ring pass over boss means contained within the matable threaded sections causing the coupling ring to deform so that the lug means seat in position adjacent the boss means emitting an audible sound in so doing.

U.S. Pat. No. 4,059,324 discloses an electrical connector having a plastic coupling member freely rotatably mounted on one housing member matably engagable with another housing member. The coupling member and the other housing member are threadably connected together to connect the matable housing members and the electrical contacts therein. A projection and slot arrangement is located on the coupling member and the other housing member which, when mated at the fully-mated condition of the housing members, visually indicates such condition.

SUMMARY OF THE INVENTION

According to one aspect, the present invention relates to a low-cost cylindrical electrical connector having metallic shells in surrounding relationship to the insulating inserts of the connector assembly.

In accordance with a further aspect thereof, the present invention is directed to improved keying means for cylindrical electrical connectors and improved tactile and audible means indicating the fully-mated condition of the matable parts of the electrical connector. It is presently common practice to provide on the mating parts of a connector assembly keys and keyways which permit mating of the two connector parts only when they are in the proper angular orientation for mating; however, it frequently happens that two or more electrical connector assemblies will be used in close proximity to each other and under circumstances where a technician might inadvertently mismate the connector parts of the two connector assemblies. It would be desirable to be able to key the parts uniquely to each other so that such mismating would be impossible. The present invention is directed to such a keying system which does permit, and provide for, unique keying arrangements for connector assemblies which prevent mismating with connector parts of adjacent connector assemblies.

It would also be desirable to know when matable parts of the electrical connector are fully mated to provide proper electrical connection, especially in areas where the connectors are located to discern whether they are fully mated. The present invention is directed to an audible and tactile means for indicating fully-mated connection of the matable parts of an electrical connector.

According to the present invention, an electrical connector comprises a connector plug part and a connector receptable part, each part comprising a molded insert and a metal cylindrical shell within which the insert is fitted and retained. The insert of the receptacle part has passageways therethrough in which are secured electrical pin terminals and an integral hood which extends beyond the mating face of the receptacle insert and the shell of the receptacle part also has a hood which extends forwardly beyond the insert hood. The plug part comprises an insert in which passageways extend therethrough in which are secured electrical receptacle terminals and a shell which has an internal surface that is radially spaced from the external surface of the plug insert so that when the two parts are mated, the hood of the receptacle insert will be received between the external surface of the plug insert and the internal surface of the plug shell. The hood of the receptacle shell extends over the external surface of the plug shell when the parts are mated and threads or the like on the external surface of the receptacle shell hood are engaged by threads provided on the internal surface of a metal coupling ring which is rotationally mounted on the plug shell. A rod member extends across the threads and engages a groove in the threads of the receptacle shell hood and the coupling ring to provide an audible and tactile indication of a fully-mated condition of the plug and receptacle parts.

According to an additional aspect of the present invention, insert keying members are provided on the external surface of the plug insert and on the internal surface of the hood portion of the receptacle insert so that these two inserts can be mated only when these keying members are properly aligned. Additional keying members are provided on the external surface of the plug shell and on the internal surface of the receptacle shell hood, and these additional keying members must also be aligned before the two connected parts can be mated to each other. Distinctive or unique keying for a particular connector assembly is achieved when the inserts are assembled to the shells of the two connector parts by mounting the inserts at predetermined locations with a predetermined angular relationship between the insert keying members and the shell keying members. A particular connector assembly having its own distinctive angular relationship between the keying members thereon cannot therefore be mated with an adjacent connector assembly having a different angular relationship between its keying members.

BRIEF DESCRIPTION OF THE DRAWINGS

FIG. 2 is a perspective view of a plug part and a receptacle part in an unassembled condition.

FIG. 3 is a part cross-sectional view of the plug part and the receptacle part of FIG. 2 in opposed aligned relationship.

DETAILED DESCRIPTION OF THE PREFERRED EMBODIMENT

Figures 1, 4:
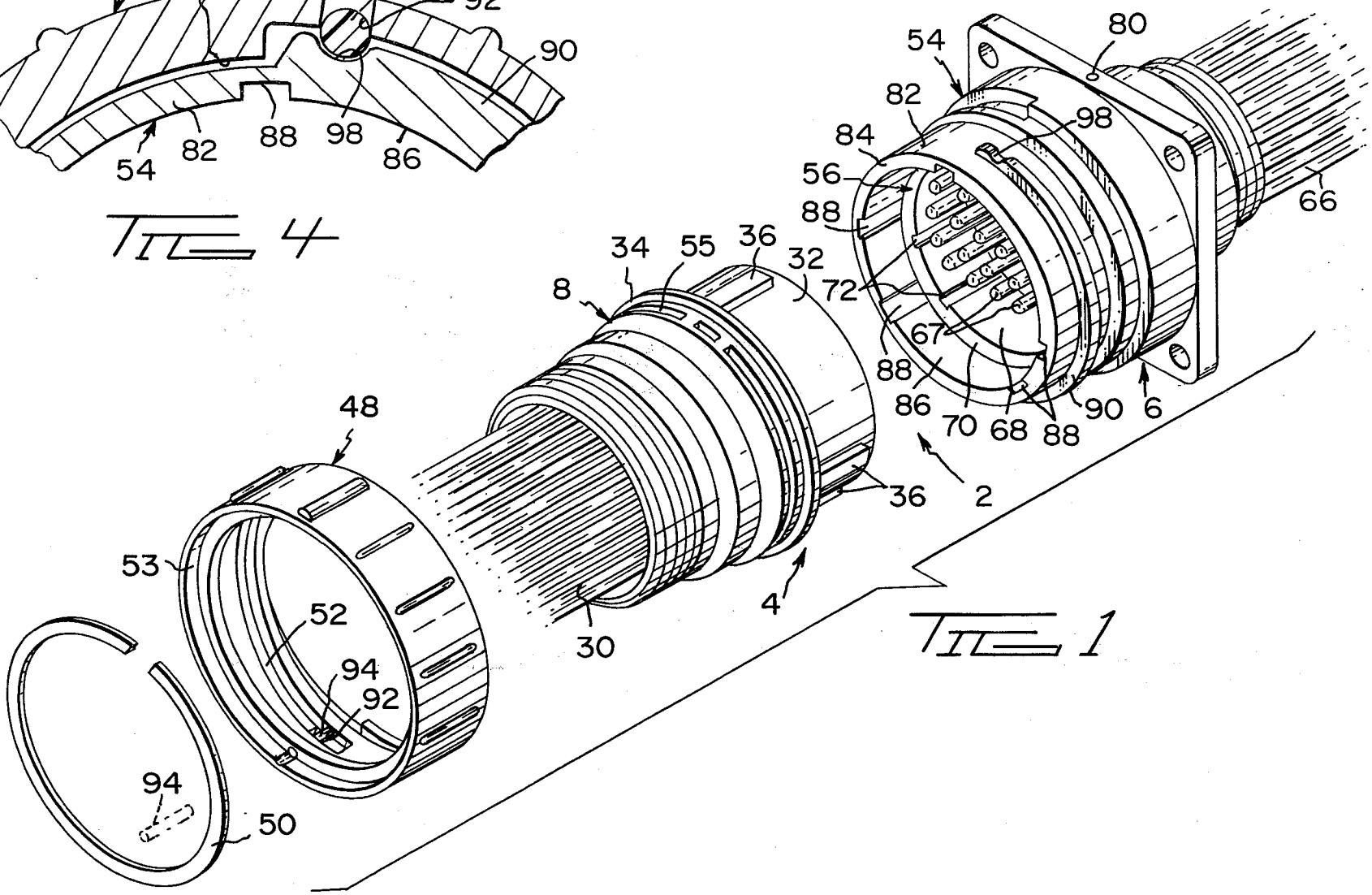
FIG. 1 is a perspective view of a connector assembly in accordance with the invention in which parts of the plug part are exploded from and in alignment with each other.
FIG. 4 is a fragmentary frontal view of the metallic shells of the plug part and receptacle part showing the audible and tactile members.

A connector assembly 2 in accordance wit the invention comprises a plug part 4 and a receptacle part 6, each part containing respective electrical pin terminals 64 and receptacle terminals 28 which are electrically connected with each other when the the parts are mated thereby electrically connecting wires 30 to wires 66.

The plug part 4 comprises a cylindrical metallic shell having a plastic molded insert 10 therein. The insert has a mating surface 12, a wire entry surface 14 at its rearward end, and a cylindrical surface having keys and spaced-apart ribs thereon as described below. The forward portion 16 of the insert 10 extends from the mating surface 12 to a first circumferential rib 18 and has a plurality of axially extending key projections 17 thereon at irregularly spaced angular intervals extending from a location adjacent to the mating surface 12 to the rib 18. A second circumferential rib 20 is located rearwardly of the rib 18 so that a recess 22 is formed which receives a locking ring 23 which mates with an annular recess 25 on the inside surface of a forward portion 32 of shell 8 by means of which the insert 10 is retained in the shell.

A plurality of terminal-receiving passageways 26 extend through the insert 10 from the surface 14 thereof to the mating surface 12, each passageway having a receptacle terminal 28 therein. These terminals are crimped onto wires 30 which extend rearwardly from the insert and from the shell 8.

The shell 8 has a forward portion 32, an intermediate circumferential rib 34 on its external surface, and a rearward portion 24 which extends rearwardly beyond the surface 14 of insert 10. A plurality of integral keys 36 are provided on the forward portion 32 of the shell and extend from a location adjacent to the forward portion 32 of the shell 8 axially to the rib 34. The internal surface 38 of the forward portion 32 of the shell 8 is radially spaced from the surface 16 of the forward portion of the insert 10 by an amount sufficient to receive a hood 68 which is integral with the insert 56 of the receptacle part 6 as will be described below. The internal surface 40 of the intermediate portion of the shell 8 is of reduced diameter and the rearward portion of the insert 10 is dimensioned to have a relatively close fit within this intermediate portion of the shell. The insert 10 is thus assembled to the shell 8 by simply moving the insert 10 into the forward portion 32 of shell 8 until the rearward portion of insert 10 is snugly seated in the reduced diameter intermediate portion 40 of the shell.

The angular relationship of the insert 10 relative to the metallic shell 8 is determined by a locating projection 42 on the internal surface of the shell 8 and a plurality of gaps or recesses 21 in the rib 20. The insert 10 can thus be positioned in any one of several rotational positions in the shell 8 depending upon which one of the several gaps 21 is aligned with the projection 42 at the time of assembly of the insert 10 in the shell 8.

A coupling ring 48 is rotatively mounted on the forward portion 32 of shell 8 and retained against axial movement by means of an external retainer ring 50 which is received in a recess 53 in coupling ring 48 and in a circumferential groove 55 in the intermediate portion of shell 8. The ring 48 is retained between this ring 50 and integral rib 34 on the shell as shown in FIG. 3. The internal surface of the coupling ring 48 is provided with screw threads 52 or their equivalent for cooperation with threads 90 on the receptacle shell 54.

The insert 56 of the receptacle part 6 has a mating surfac 58, a wire entry surface 60, and a plurality of passageways 62 extending therethrough, each of which contains a pin terminal 64 crimped onto a wire 66. The pin terminals 64 have pin sections 67 which extend beyond the mating surface 58 and which are dimensioned to be received in the receptacle sections of receptacle terminals 28. The insert 56 has an integral hood 68 which surrounds and extends forwardly from the mating surface 58. The leading edge 70 of hood 68 is located beyond the ends of pin sections 67 of the pin terminals 64 and is recessed from the leading edge 84 of hood portion 82 of shell 54. The internal surface of hood 68 is provided with keyways 72 located to receive the integral key projections 17 on the plug insert 10.

A circumferential rib 74 on insert 56 is received within a counterbore 76 in the rearward end of the receptacle shell 54 and insert 56 is retained in shell 54 by means of one or more pins 80 which are driven radially through shell 54 and into rib 74. The shell hood 82 has an internal surface 86 which is spaced from the external surface of the insert hood 68 and is provided with keyways 88 which are dimensioned to receive the key projections 36 on the plug shell 8.

This unique keying arrangement between the shell 8 and insert 10 and the shell 54 and insert 56 respectively is disclosed in U.S. Pat. application Ser. No. 235,455, filed Feb. 18, 1981, and the disclosure thereof is incorporated by reference herein.

A hole 92 extends through the adjacent crowns of threads 52 of coupling ring 48. A rod 94 of a suitable plastic material such as nylon is secured in hole 92 and it extends across the root of the adjacent crowns. An opening 96 extends through coupling ring 48 in alignment with rod 94. A groove 98 is located in the crown of thread 90 adjacent its outer end which is radiussed to permit rod 94 to ride therealong and into groove 98 when threads 52 and 90 are threadably engaged at their fullest extent. The movement of rod 94 into groove 98 when threads 52 and 90 of coupling ring 48 and shell 54 respectively are threadably mated provides a tactile and audible indication that plug part 4 and receptacle part 6 are fully mated and receptacle terminals 28 are properly electrically connected to pin terminals 64. The opening 96 enables rod 94 to flex thereinto when rod 94 is moved along the radiussed section of thread 90. Rod 94 in groove 98 also prevents coupling ring 98 from vibrating out of the fully-mated position. The ends of threads 52 and 90 also engage when rod 94 moves into groove 98 adding to the audible indication of a fully-mated condition.

Figure 5:
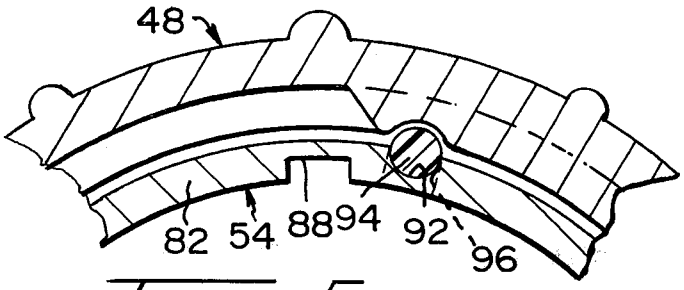
FIG. 5 is a view similar to FIG. 4 showing an alternative embodiment.
Figure 7:
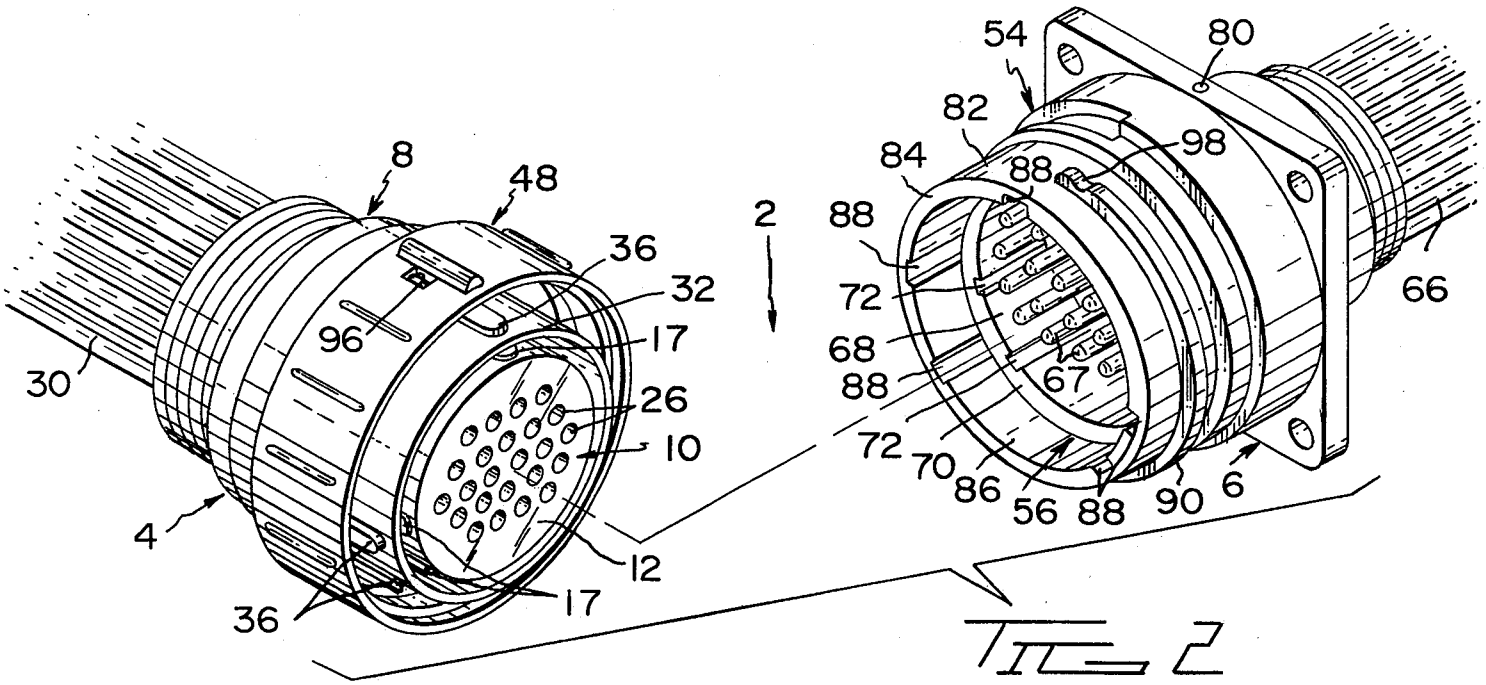
Figure 7:
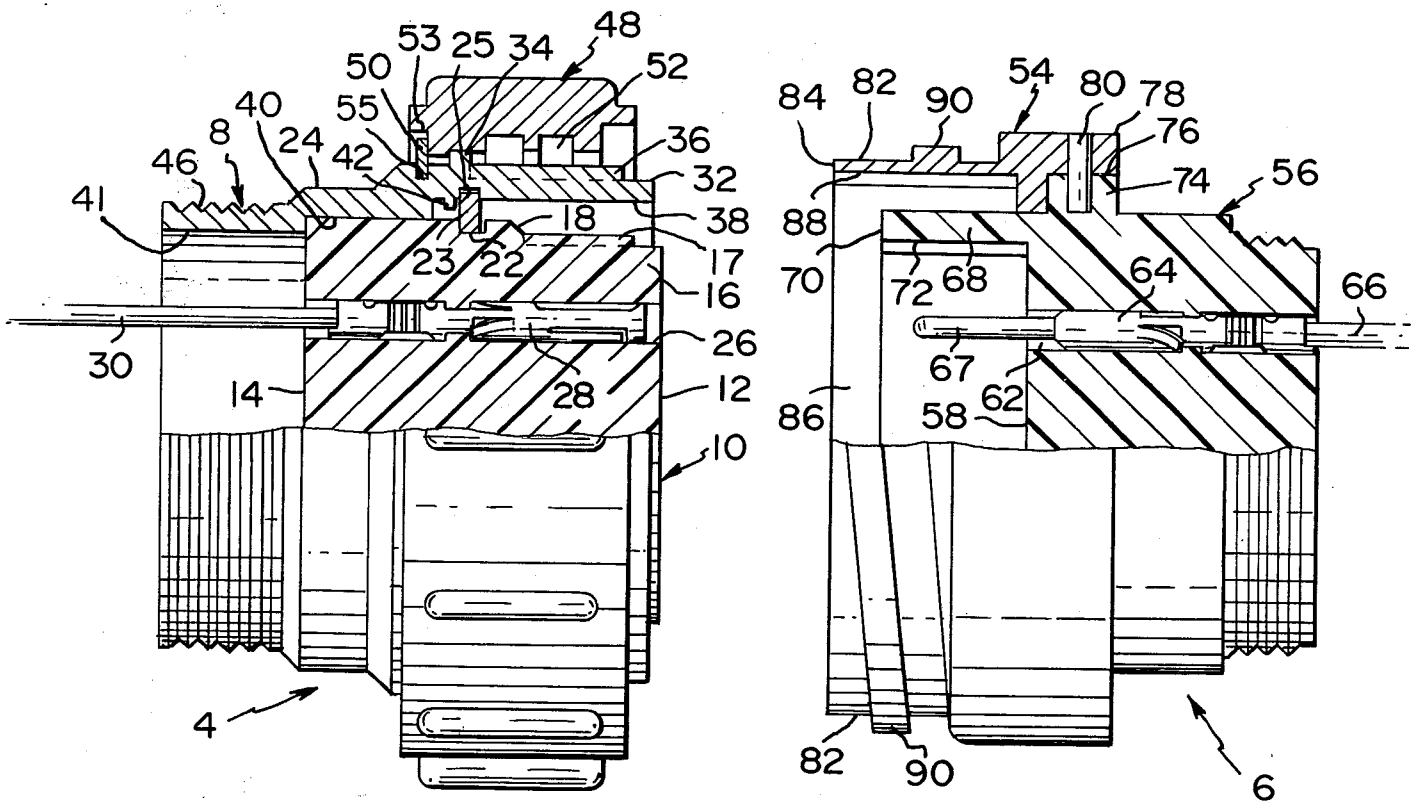

An alternative embodiment is shown in FIG. 5 wherein rod 94 is disposed in a hole 92 which axially extends across the inner end of thread 90 of shell 54 and groove 98 is located adjacent the inner radiussed end of thread 52 of coupling ring 48. Opening 96 is in shell 54 in alignment with rod 94.

Opening 96 is not necessary and can be eliminated if desired because rod 94 can still function due to it being deformed while engaging the radiussed end of thread 52. Rod 94, due to its memory characteristics, will return to its original form after being deformed.

When a connector assembly in accordance with the present invention if first assembled, the plug insert 10 is positioned in the plug shell 8 in a predetermined orientation relative to the plug shell 8 which is determined by the particular gap or recess which is aligned with the projection 42 at the time of assembly. When the receptacle insert 56 is assembled to the receptacle shell 54, it is necessary to assemble these parts in the same relative positions as that selected for the plug insert 10 and shell 8. When the assembly is thereafter put to use, the key projections 17, 36 and keyways 72, 88 on the plug 4 and on the receptacle 6 must be respectively aligned before the coupling nut 48 can draw the plug 4 and receptacle 6 together via coupling ring 48. If an attempt is made to mate the connector parts which are not properly keyed to each other, it will be impossible to move them sufficiently close together to permit the threads 52, 90 on the coupling nut 48 and on the receptacle shell 54 to engage. It is thus impossible to mismate the parts of adjacent connector assemblies which are not specifically keyed to each other. The rod 94 moving into groove 98 provides a tactile and audible indication of the fully-mated condition of the connector parts.

The practice of the invention provides a low-cost cylindrical connector assembly since the inserts can be the same as the connector parts described in U.S. Pat. No. 3,901,574. The plastic coupling nut shown in this patent is not provided on the plug and the external threads shown in that patent on the receptacle need not, of course, be provided in the practice of the present invention. The metallic shells used in the practice of the invention are advantageously die castings and can therefore be produced at low cost and are easily assembled to the inserts as described above.

We claim:

1. An electrical connector of the type comprising:

a first shell;

a first insulating insert secured in said first shell, said first insert having a plurality of passageways extending therethrough;

a second shell having a forward and rearward section, thread means on an outside surface of said forward section;

a second insulating insert secured in said second shell, said second insert having a plurality of passageways extending therethrough;

a plurality of first electrical terminals, each being secured in a respective passageway of said first insert;

a plurality of second electrical terminals, each being secured in a respective passageway of said second insert and being matable with said first electrical terminal; and coupling means for connecting said first and second shells together so that electrical connection is made between respective ones of said first and second electrical terminals characterized in that:

said coupling means comprises a ring rotatably mounted on said first shell and having thread means threadably engagable with said thread means on said second shell to maintain said shells coupled together, a groove disposed in one of the thread means of said ring or said second shell;

a rod secured in an axial direction in and by the thread means in the other of said ring or said second shell and being tactilely and audibly positioned in said groove to indicate the fully-mated condition of said shells, inserts and electrical terminals.

2. An electrical connector as set forth in claim 1 characterized in that said rod is plastic material.

3. An electrical connector as set forth in claim 1 characterized in that an opening is located in said second shell or said ring in alignment with said rod.

4. An electrical connector as set forth in claim 1 characterized in that said shells and said inserts have matable key projections and keyways to assure proper mating engagement therebetween.

5. An electrical connector as set forth in claim 4 characterized in that said first shell and said first insert have forward sections spaced from each other defining an annular space;

said forward section of said second shell comprising an outer hood and said second insert including an inner hood;

said outer hood receiving and covering said forward section of said first shell and said inner hood being disposed in said annular space when said shells, inserts and electrical terminals are mated.

6. An electrical connector as set forth in claim 5 characterized in that said forward sections of said first shell and insert and said outer and inner hoods have said matable key projections and keyways.

7. A separable electrical connecton comprising:

first and second shells connectable in alignment along a common axis;

interfitting keying means on the shells to allow their axial approach and retreat relative to each other;

an insulating insert mounted within each shell;

cooperating pin and receptacle-type electrical terminals, said pin terminals mounted in one of said inserts and said receptacle terminals mounted in said other insert, said pin and terminal receptacles connectable in mated relationship; and means for connecting and disconnecting the first and second shells together, said means comprising:

a coupling ring rotatably mounted on one of said shells; and interfitting thread means on said other shell including an axially extending groove adjacent an outer end of said thread means and said ring having an axially extending resilient rod secured within its thread means, said groove adapted to engage the rod in said ring when both said thread means are fully engaged, whereby when said first and second shells are placed in axial alignment with said keying means interfitting and said ring is rotated in one direction, the threads in said ring interfit with the threads on said other shell drawing the pin and receptacle terminals together in mated relationship until said rod engages said groove, whereby there is tactile and audible indication that the shells, inserts and terminals are fully engaged.

8. A separable electrical connector as set forth in claim 7 wherein said inserts include interfitting keying means and said inserts are positionable relative to their respective shells so that said shells and their respective inserts are matably engagable.

9. A separable electrical connector as set forth in claim 7 wherein said first shell and its insert have forward sections spaced from each other defining an annular space therebetween;

said second shell and its insert have hood sections with the shell hood section covering the insert forward section and the insert hood section being disposed within said annular space when said shells and inserts are mated.

10. A separable electrical connector as set forth in claim 7 wherein said groove is located at the beginning of said thread means and said rod extends across said thread means at the inner end thereof.

11. A separable electrical connector as set forth in claim 7 wherein said ring has an opening in alignment with said rod.

12. An electrical connector assembly comprising:

a first shell;

a first insulating insert mounted in said first shell, said insert having a plurality of axial passages therethrough;

a second shell having a forward and rearward portion, thread means on the forward portion of the outside of said second shell;

a plurality of first electrical terminals, each mounted in a respective axial passage in said insert;

a plurality of second electrical terminals mounted in said second shell and adapted to mate with said first terminals; and means for connecting said first and second shells together and holding said electrical terminals together in mated position, said means comprising:

a ring rotatably mounted on said first shell, said ring having thread means connectable to the thread means on said second shell, rod means disposed axially along and secured in and by the thread means of said second shell or said ring and a groove located in the thread means of said second shell or said ring, whereby when said first and second electrical terminals are placed in axial alignment and thrust towards each other and said ring is rotated in one direction, the threads in said ring connect to the threads on said second shell drawing the electrical terminals into mated relationship until said rod means audibly and tactilly comes to rest in said groove thereby indicating a fully-mated condition of said shells and said electrical terminals.

13. An electrical connector assembly as set forth in claim 12 wherein said second shell includes a second insulating insert secured therein, said second insert having axial passageways therethrough with each of said second electrical terminals in a respective passageway of said second insert.

14. An electrical connector assembly as set forth in claim 13 wherein said second shell and said second insert include hood section that overlie forward sections of said first shell and said first insert when mated together.

15. An electrical connector assembly as set forth in claim 14 wherein said forward sections of said first shell and said first insert and said hood sections include key means to assure positive mating engagement therebetween.

* * * * *